US010344937B2

(12) United States Patent
Martus et al.

(10) Patent No.: US 10,344,937 B2
(45) Date of Patent: Jul. 9, 2019

(54) LIGHT GUIDE FOR AUTOMOTIVE LIGHTING

(71) Applicant: Valeo North America, Inc., Troy, MI (US)

(72) Inventors: Cameron Martus, Brownstown, IN (US); Colby Darlage, Seymour, IN (US); Todd Cleavenger, Seymour, IN (US)

(73) Assignee: Valeo North America, Inc., Troy, MI (US)

( * ) Notice: Subject to any disclaimer, the term of this patent is extended or adjusted under 35 U.S.C. 154(b) by 9 days.

(21) Appl. No.: 15/664,915

(22) Filed: Jul. 31, 2017

(65) Prior Publication Data

US 2019/0032884 A1 Jan. 31, 2019

(51) Int. Cl.

| | |
|---|---|
| ***F21S 43/245*** | (2018.01) |
| ***F21S 43/237*** | (2018.01) |
| ***F21S 43/50*** | (2018.01) |
| ***F21S 43/239*** | (2018.01) |

(52) U.S. Cl.

CPC ..... *F21S 43/245* (2018.01); *F21S 43/237* (2018.01); *F21S 43/239* (2018.01); *F21S 43/50* (2018.01)

(58) Field of Classification Search

USPC ..... 362/511

See application file for complete search history.

(56) References Cited

U.S. PATENT DOCUMENTS

| | | | |
|---|---|---|---|
| 9,599,308 B2 | 3/2017 | Ender et al. | |
| 2008/0074896 A1* | 3/2008 | Ishida | F21V 5/04 362/516 |

FOREIGN PATENT DOCUMENTS

| | | |
|---|---|---|
| FR | 3 034 496 A1 | 10/2016 |

* cited by examiner

*Primary Examiner* — Matthew Mikels

(74) *Attorney, Agent, or Firm* — Oblon, McClelland, Maier & Neustadt, L.L.P.

(57) ABSTRACT

A light assembly for a vehicle including a light source that provides an incident light, a pair of bezels adjacent to the light source, and a light guide. The light guide has an entrance face that receives the incident light, an exit face from which the incident light exits the light guide, an outboard face that joins the entrance face and the exit face, an inboard face opposite to the outboard face, and a side cut that joins the inboard face to the exit face, wherein the side cut deviates the incident light to spread the exiting light between a maximum inboard angle and a maximum outboard angle.

20 Claims, 5 Drawing Sheets

LIGHT GUIDE FOR AUTOMOTIVE LIGHTING

BACKGROUND

Field of the Disclosure

The present disclosure relates to automotive lighting systems, and in particular to optical elements in automotive lighting systems.

Description of the Related Art

In today's automotive industry, lighting systems need to provide not only a certain level of visibility, but also an aesthetic appeal to consumers. Notably, due to customer popularity and stylistic identification with certain automotive manufacturers and/or models, some lighting systems need to provide a light blade. Such a light blade generally provides a long, seamless, slender appearance in an unlit state. However, such an appearance in the lit state can make the meeting of photometric requirements challenging.

To this end conventional light blades may rely on additional optical elements such as pillows, prisms, or other types of lenses that deviate light to meet photometric requirements. However, these additional optical elements may cause, in an unlit state, an appearance that does not appeal to consumers.

SUMMARY

Accordingly, one of the objects of the present disclosure is to provide an automotive light assembly that provides an appearance that is appealing to consumers both in an unlit and lit state, and also meets photometric requirements.

The automotive light assembly of the present disclosure provides exiting light that meets aesthetics and photometric requirements without the need of external and/or additional optical elements by relying on a light guide that internally reflects and spreads transiting light.

The automotive lighting system disclosed can be oriented along a first direction, e.g. vertical direction, and have a rather thin dimension in a second direction substantially perpendicular to the first direction, e.g. horizontal direction, and can distribute exiting light in the second direction to meet photometric requirements, e.g. a pattern that meets regulatory test points.

Contrary to conventional lighting systems, the distribution of exiting light in the second direction is obtained without additional optical elements, such as pillows, prisms or other types of lenses, that may cause a jagged and/or non-uniform appearance when the conventional lighting system is in the unlit state, and a pixelated appearance in a lit state, which may not be appealing to consumers.

The lighting system disclosed achieves sufficient distribution of exiting light in the second direction to meet photometric requirements by relying on a side cut placed on an inboard side that causes transiting light to internally reflect toward an outboard side opposite to the inboard side.

In one non-limiting illustrative example, a lighting assembly is presented. The light guide includes an entrance face that receives an incident light, an exit face from which light exits the assembly, a side wall that joins the entrance face and the exit face, and a side cut positioned on the side wall, wherein the side cut deviates the light incident on itself and spreads it between a maximum inboard angle and a maximum outboard angle.

In one non-limiting illustrative example, a lighting assembly for a vehicle is presented. The lighting assembly includes a light source that provides an incident light, a pair of bezels adjacent to the light source, and a light guide. The light guide has an entrance face that receives the incident light, an exit face from which light exits the assembly, an outboard face that joins the entrance face and the exit face, an inboard face opposite to the outboard face, and a side cut that joins the inboard face to the exit face, wherein the side cut deviates the light incident on itself and spreads it between a maximum inboard angle and a maximum outboard angle.

In one non-limiting illustrative example, a lighting system for a vehicle is presented. The lighting system for a vehicle includes a power source, a printed circuit board coupled to the powersource, and a light assembly operatively connected to the printed circuit board. The light assembly has a light source that provides an incident light, a pair of bezels adjacent to the light source, and a light guide. The light guide has an entrance face that receives the incident light, an exit face from which light exits the assembly, an outboard face that joins the entrance face and the exit face, an inboard face opposite to the outboard face, and a side cut that joins the inboard face to the exit face, wherein the side cut deviates the light incident on itself and spreads it between a maximum inboard angle and a maximum outboard angle.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
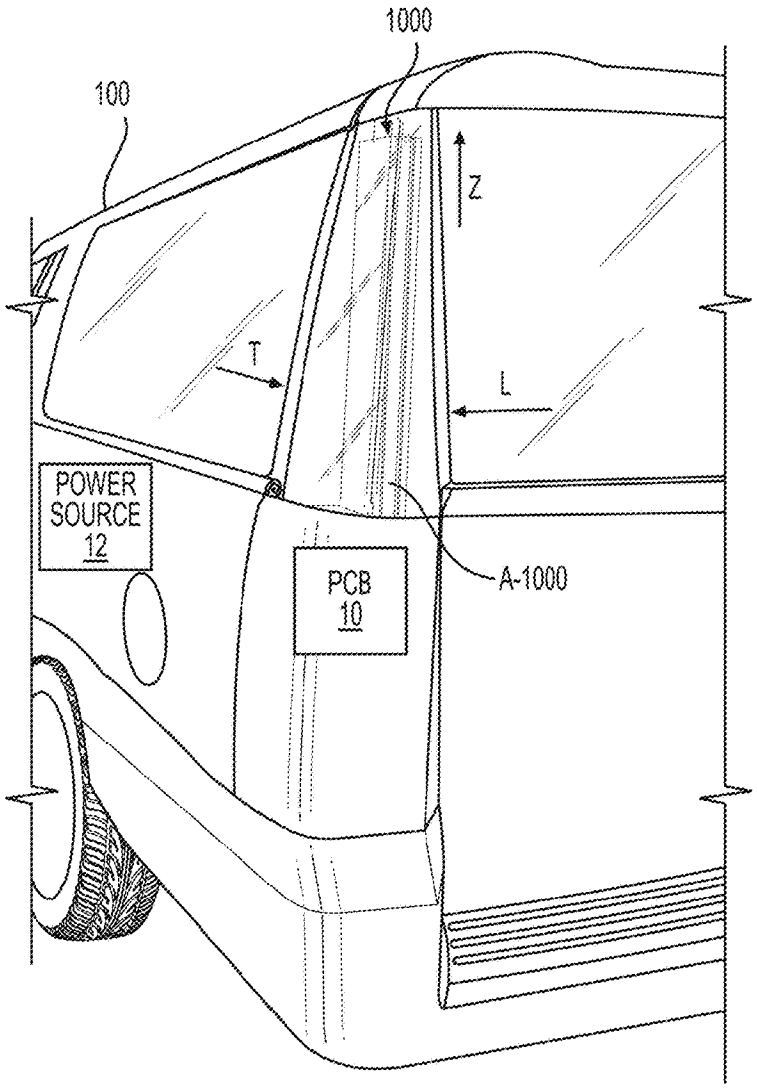
FIG. 1 is a perspective view of the light assembly mounted in a vehicle, according to certain aspects of the disclosure.

The materials, methods, and examples discussed herein are illustrative only and are not intended to be limiting.

In the drawings, like reference numerals designate identical or corresponding parts throughout the several views. Furthermore, as used herein, the words "a", "an", and the like include a meaning of "one or more", unless stated otherwise. The drawings are generally drawn not to scale unless specified otherwise or illustrating schematic structures or flowcharts.

The features of the present disclosure provide improvements in the technical field of automotive lighting, and specifically in the field of automotive light guides.

Conventional light guides for automotive lighting systems can have a flat or angled exit face with an exiting light that is rather concentrated in one direction, e.g. horizontal direction, so that the exiting light does not meet extreme test points of outboard visibility that are part of photometric requirements.

Contrary to conventional light guides, the disclosed light guide can have a cross section slightly thicker than the visible exit face with a curved cut extending hack from an inboard side of the visible exit face. Such a design causes total internal reflection of light off the curved cut on the inboard side which will then be directed toward the outboard side of the light guide, enabling the light guide to meet photometric requirements. Furthermore, the exit face can have a concave shape, spreading the exiting light so as to meet test points and achieve a uniform distribution.

As noted above, it is desirable to provide an automotive light assembly that meets photometric requirements in a lit state and provides a smooth appearance in both an unlit state and a lit state.

Figure 2:
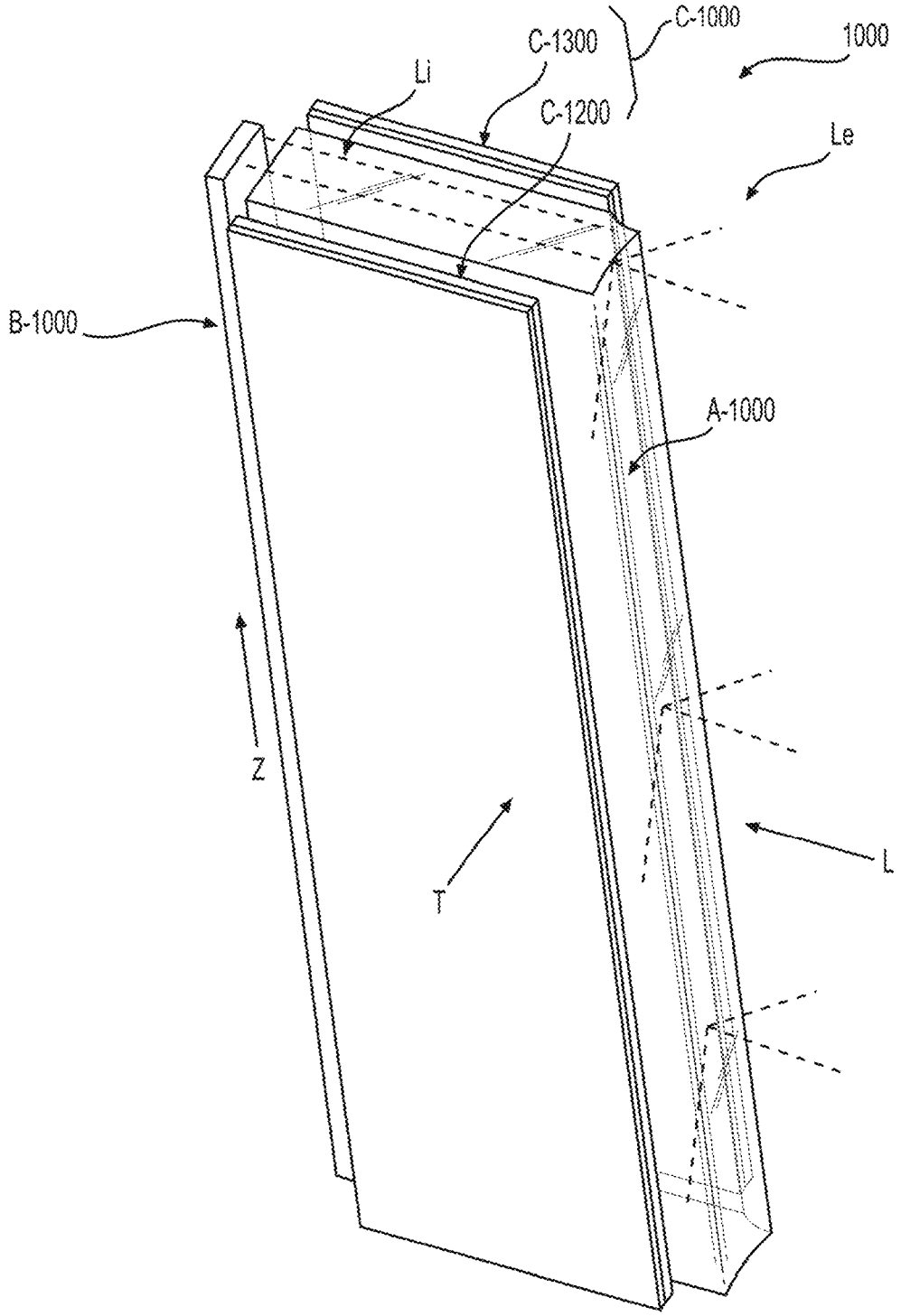
FIG. 2 is a perspective view of the light assembly alone, according to certain aspects of the disclosure.

FIG. 1 is a perspective view of a light assembly 1000 mounted in a vehicle 100 and FIG. 2 is a perspective view of the light assembly 1000 alone, according to certain aspects of the disclosure.

A lighting system of a vehicle 100 can include a power source 12, e.g. battery, alternator, or the like, that provides an input power, a printed circuit board (PCB) 10 coupled to the power source 12 that receives the input power and provides a modulated power, and a light assembly 1000 that receives the modulated power to signal driving operations, e.g. turning, braking, backing up, or the like.

The light assembly 1000 is configured to provide predetermined photometric and aesthetic requirements with limited use or without the use of additional optical elements, e.g. external reflective and/or refractive lenses, positioned internally or externally to the light assembly 1000.

The aesthetic requirements can be such that the light assembly 1000 provides a predetermined appearance, e.g. a light blade shape, when an observer looks in a first direction L, e.g. longitudinal direction of the vehicle 100, and a transparent or unlighted appearance when the observer looks in a second direction T, e.g. sidewise direction of the vehicle 100, while the photometric requirements can be such that the light assembly 1000 provides a sufficiently large distribution of light around the first direction L.

The light assembly 1000 can include a pair of bezels C-1000, a light source B-1000 positioned adjacent to the pair of bezels C-1000, and a light guide A-1000 positioned between the pair of bezels C-1000 and in front of the light source B-1000.

The pair of bezels C-1000 can be configured to partially enclose the light guide A-1000 and to leave a peripheral portion of the light guide A-1000 unmasked.

For example, the pair of bezels C-1000 can include an outboard bezel C-1200 positioned along the outboard face A-1200, and an inboard bezel C-1300 positioned along the inboard face A-1300. The outboard bezel C-1200 and the inboard bezel C-1300 can have similar shapes that follow the outboard face A-1200 and the inboard face A-1300 as well as similar dimensions corresponding to dimensions of the outboard face A-1200 and the inboard face A-1300.

Alternatively, the outboard bezel C-1200 can have a length shorter than the length of the inboard bezel C-1300, as illustrated in FIG. 2, to provide a transparent and smooth appearance when the observer looks at the light assembly 1000 in the second direction T. The light source B-1000 can be configured to provide to the light guide A-1000 an incident light Li substantially homogeneous along an axial direction Z, e.g. vertical direction. For example, the light source B-1000 can include a plurality of individual solid state light sources, e.g. light emitting diodes (LEDs), organic light emitting diodes (OLEDs), polymer light emitting diodes (PLEDs), and/or monolithic LEDs, positioned adjacently from each other along the axial direction Z, or a light tube, light pipe, or similar light guiding device, extending in the axial direction.

In addition, the light source B-1000 can be configured to provide the incident light Li with a color that meets photometric requirements, e.g. red, amber, or yellow when the light assembly 1000 is used as a light signal.

Figure 3A:
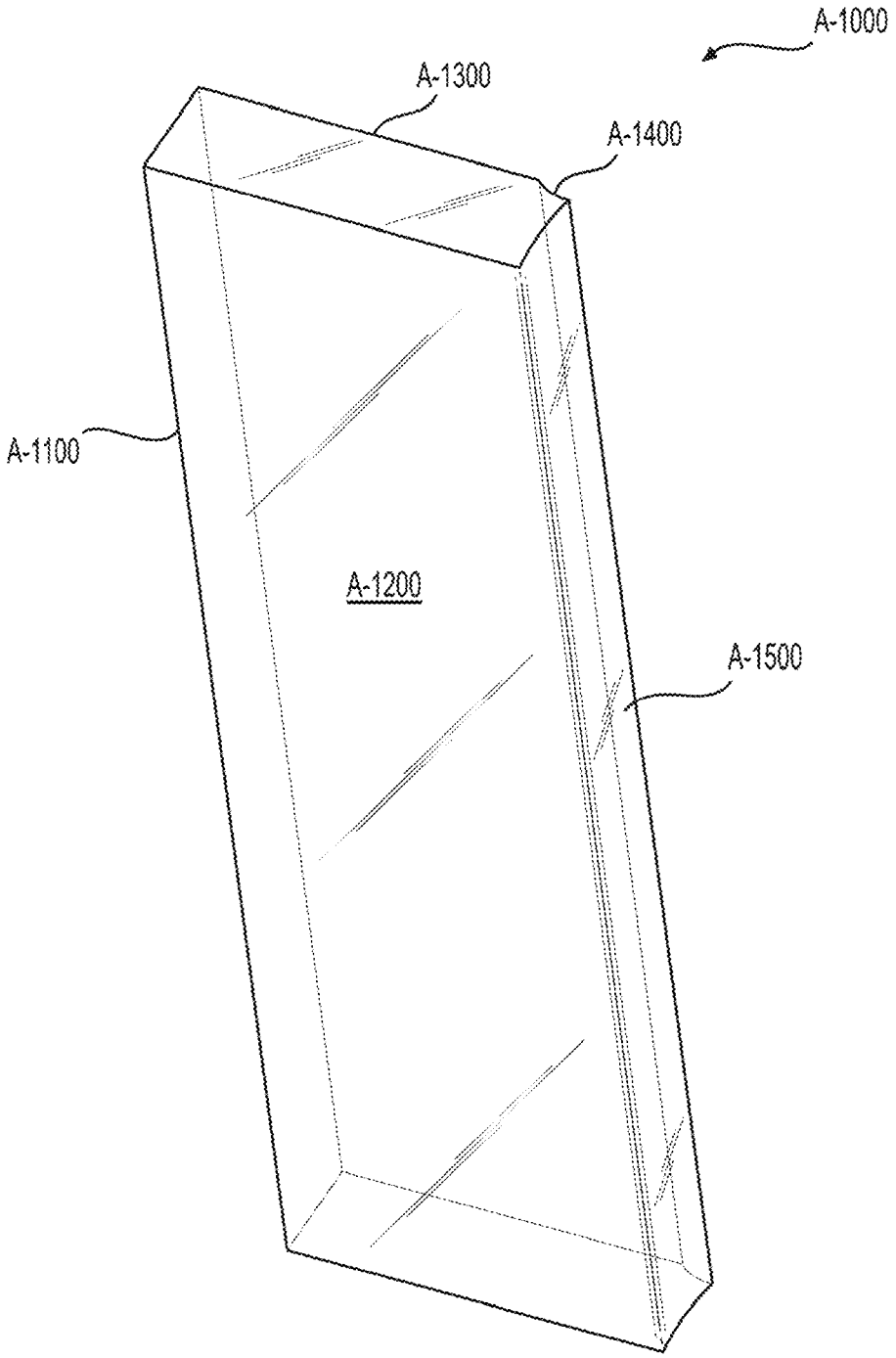
FIG. 3A is a perspective view of the light guide in the light assembly, according to certain aspects of the disclosure.
Figure 3B:
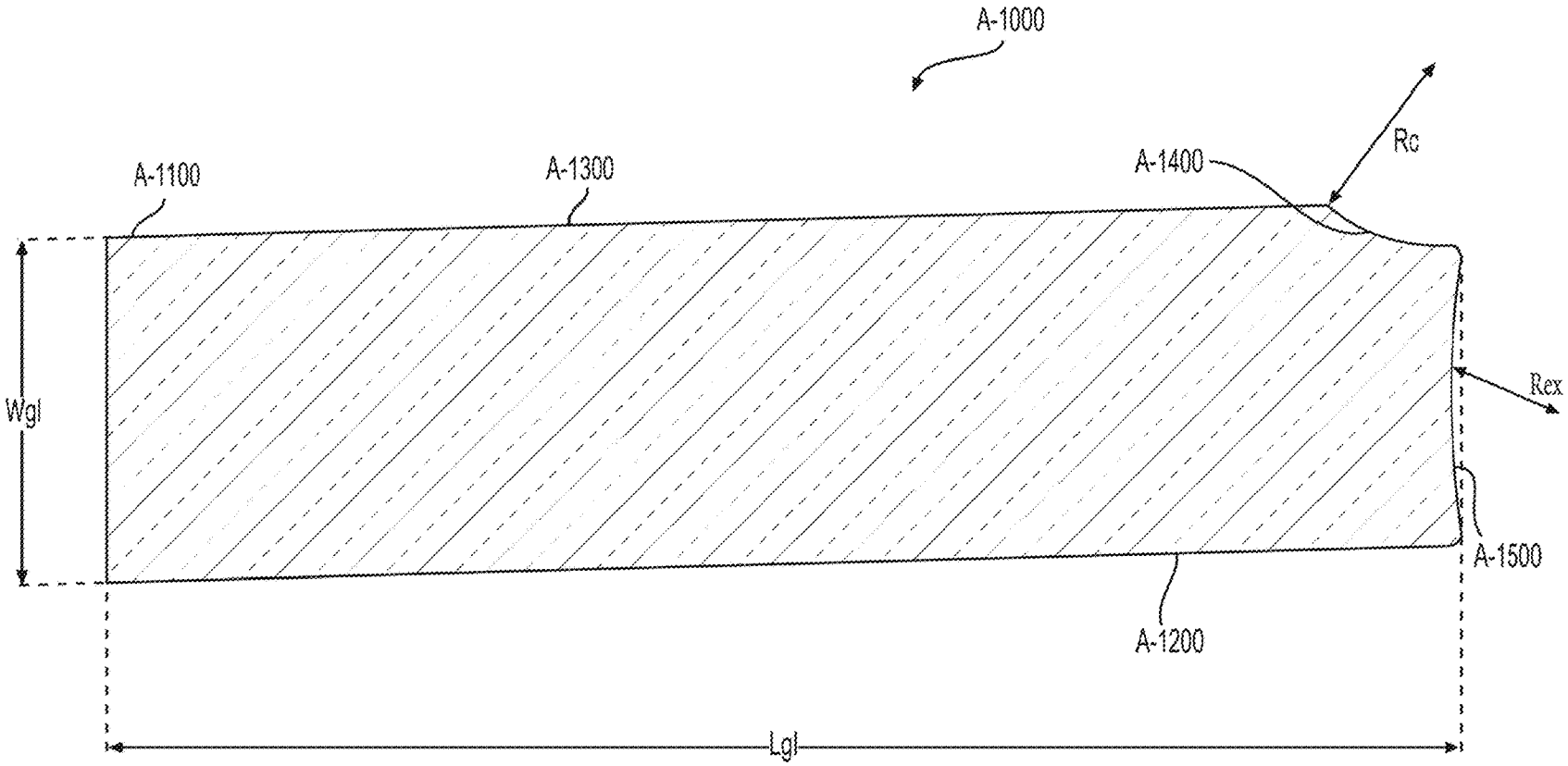
FIG. 3B is a sectional view of a light guide, according to certain aspects of the disclosure.
Figure 3C:
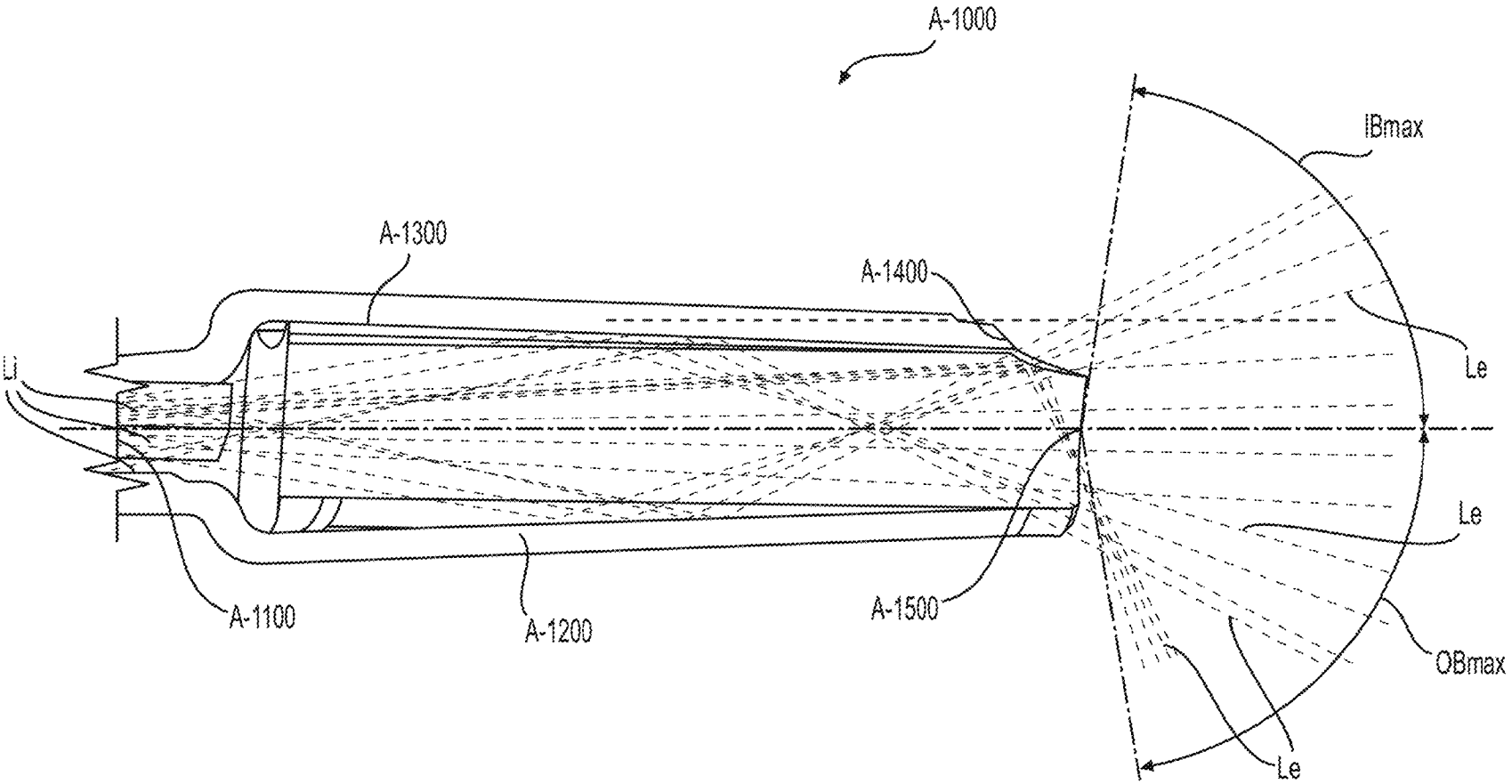
FIG. 3C is a top view of the light guide with incident light and exiting light, according to certain aspects of the disclosure.

The light guide A-1000 can be configured to receive the incident light Li emitted by the light source B-1000 and provide an exiting light Le that spreads between a maximum inboard angle IBmax and a maximum outboard angle OBmax with a predetermined minimum intensity Imin to meet photometric requirements, as illustrated in FIG. 3C.

FIG. 3A is a perspective view of the light guide A-1000 of the light assembly 1000, FIG. 3B is a sectional view of the light guide A-1000, and FIG. 3C is a top view of the light guide A-1000 with incident light Li and exiting light Le, according to certain aspects of the disclosure.

The light guide A-1000 can include an entrance face A-1100 that faces the light source B-1000, an exit face A-1500 opposite to the entrance face A-1100, an outboard face A-1200 that joins the entrance face A-1100 and the exit face A-1500, an inboard face A-1300 opposite to the outboard face A-1200, as seen in FIGS. 3A-3C, and a side cut A-1400 that joins the inboard face A-1300 to the exit face A-1500.

The entrance face A-1100 can receive the incident light Li, while the outboard face A-1200 and the inboard face A-1300 can reflect the incident light Li towards the exit face A-1500.

The reflection of the incident light Li on the outboard face A-1200 and the inboard face A-1300 provides an unlighted appearance when the observer looks at the light assembly 1000 in the second direction T. The unlighted appearance can be generated by preventing the incident light Li from exiting the light guide A-1000 through the outboard face A-1200 or the inboard face A-1300. This can be done by providing light input Li such that light is guided by total internal reflection on the outboard face A-1200 and the inboard face A-1300 of the light guide A-1000.

The side cut A-1400 is configured to divert an amount of the incident light Li through the exit face A-1500 or through the outboard face A-1200 to outboard angles in order to spread the exiting light Le to meet photometric test points. Thus, the side cut A-1400 provided on the light guide can provide a light output which minimizes or eliminates the need for optical elements typically required to meet photometric requirements.

For example, the side cut A-1400 in correlation with or without the other elements of the light guide A-1000, e.g. the entrance face A-1100, the exit face A-1500 the outboard face A-1200, and/or the inboard face A-1300, can have geometrical characteristics, e.g. shapes and/or dimensions, that divert sufficiently the incident light Li to spread the exiting light Le between the maximum inboard angle IBmax and the maximum outboard angle OBmax with the predetermined minimum intensity Imin to meet photometric requirements, as shown in FIG. 3C.

The side cut A-1400 can have a profile that curves towards the outboard face A-1200 and can be characterized by a radius of curvature Rc. The radius of curvature Rc can be determined based on the maximum board angle IBmax, the maximum outboard angle OBmax, the predetermined minimum intensity Imin, and/or the dimensions of the light guide A-1000, e.g. a length Lg1 and/or a width Wg1 of the light guide A-1000.

For example, the radius of curvature Rc can be between 1 mm and 20 mm and preferably between 5 mm and 10 mm, the maximum inboard angle IBmax can be between 10° and 90° and preferably between 40° and 60°, the maximum outboard angle OBmax can be between 10° and 100° and preferably between 75° and 95°, the length Lg1 of the light guide A-1000 can be between 20 mm and 100 mm and preferably between 50 mm and 70 mm, and the width Wg1 of the light guide A-1000 can be between 5 mm and 50 mm and preferably between 10 mm and 30 mm.

The exit face A-1500 may be flat, or can have a concave shape to cause the exiting light to diverge. The concave shape of the exit face A-1500 can be characterized by a radius Rex such that the exiting light rays diverge and spread the exiting light Le over a wider angular range. For example, the radius Rex can be between 20 mm and 100 mm, and preferably between 35 mm and 55 mm.

In another example, the exit face A-1500 can have a convex shape to capture the incident light Li reflected by the side cut A-1400. The convex shape of the exit face A-1500 can be configured to converge the light output such that output rays cross over each other to effectively provide a diverging output from the exit face A-1500. The light guide A-1000 can be made of a transparent material such as glass or polycarbonate and be characterized by a transmissivity factor f between 0.50 and 0.95, and preferably between 0.70 and 0.90.

The outboard face A-1200 and the inboard face A-1300 may have discrete sides that are substantially parallel to each other, as illustrated in the example of FIG. 3A-3C, or form a continuous side wall that joins the entrance face A-1100 and the exit face A-1500.

The features of the present disclosure provide a multitude of improvements in the technical field of automotive lighting system, and notably compared to conventional light guides.

Conventional light guides for automotive lighting systems can have a flat or angled face with an exiting light that is rather concentrated in one direction, e.g. horizontal direction, so that the exiting light does not meet the extreme test points of outboard visibility that are part of photometric requirements, Contrary to conventional light guides, the disclosed light guide can have a cross section slightly thicker than the exit face with a curved cut extending back from the inboard side of the exit face. Such a design will cause total internal reflection of light off the curved cut on the inboard side which will then be directed toward the outboard side, enabling the design to meet photometric requirements. Furthermore, the exit face can have a concave shape, spreading the exiting light so as to meet test points and achieve a uniform distribution.

The foregoing discussion discloses and describes merely exemplary embodiments of an object of the present disclosure. As will be understood by those skilled in the art, an object of the present disclosure may be embodied in other specific forms without departing from the spirit or essential characteristics thereof. Accordingly, the present disclosure is intended to be illustrative, but not limiting of the scope of an object of the present disclosure as well as the claims.

Numerous modifications and variations on the present disclosure are possible in light of the above teachings. It is therefore to be understood that within the scope of the appended claims, the disclosure may be practiced otherwise than as specifically described herein.

What is claimed is:

1. A light guide comprising:

an entrance face that receives incident light;

an exit face from which the incident light exits the light guide;

a first side wall that joins the entrance face and the exit face such that the incident light is guided by total internal reflection (TIR) to the exit face; and a second side wall that joins the entrance face and the exit face, a curved side cut being positioned in the first side wall, and being cut into the body of the light guide extending between the entrance face, the exit face, the first side wall and the second side wall and being configured to divert the incident light to spread the exiting light over a predetermined angular range with respect to the first side wall, wherein the first side wall is substantially parallel to the second side wall.

2. The light guide of claim 1, wherein the exit face is concave such that the exiting light is diverging to spread the exiting light over a predetermined range.

3. The light guide of claim 1, wherein the exit face is convex such that the exiting light is converging to spread the exiting light over a predetermined range.

4. The light guide of claim 1, wherein the first side wall is a continuous surface.

5. The light guide of claim 1, wherein the first side wall and the second side wall includes an inboard face and an outboard face substantially parallel to the inboard face.

6. The light guide of claim 4, wherein the side cut is a curved surface pointing towards the outboard face of the first side wall to reflect the incident light towards outboard angles.

7. The light guide of claim 6, wherein the curved surface has a radius of curvature between 1 mm and 20 mm, a length of the light guide is between 20 mm and 100 mm, and a width of the light guide is between 5 mm and 50 mm.

8. The light guide of claim 7, wherein the exiting light has a predetermined angular range defined by a maximum angle of between 10° and 100° with respect to one surface of the first side wall, and a maximum angle of between 10° and 90° with respect to another surface of the first side wall opposed to the one surface of the first side wall.

9. A light assembly comprising:

a light source that provides incident light;

a pair of bezels adjacent to the light source; and a light guide having:

an entrance face that receives the incident light, an exit face from which the incident light exits the light guide, an outboard face that joins the entrance face and the exit face, and an inboard face opposite to the outboard face, a curved side cut being positioned in the inboard face joining the inboard face to the exit face and being cut into the body of the light guide extending between the entrance face, the exit face, the outboard face and the inboard face, the side cut being configured to divert the incident light to spread the exiting light over a predetermined angular range with respect to the inboard face without additional optical elements, the outboard face being substantially parallel to the inboard face.

10. The light assembly of claim 9, wherein the incident light is substantially homogeneous in an axial direction.

11. The light assembly of claim 10, wherein the light source includes a tubular light guide extending along the axial direction.

12. The light assembly of claim 10, wherein the light source includes a plurality of individual solid state light sources placed equidistantly along the axial direction of the light guide.

13. The light assembly of claim 9, wherein the side cut is a curved surface pointing towards the outboard face to reflect the incident light towards the exit face and to direct the exiting light in an outboard direction.

14. The light assembly of claim 13, wherein the curved surface has a radius of curvature between 1 mm and 20 mm, a length of the light guide is between 20 mm and 100 mm, and a width of the light guide is between 5 mm and 50 mm.

15. The light assembly of claim 14, wherein the exiting light has a predetermined angular range defined by an maximum angle of between 10° and 100° with respect to one surface of the inboard face, and a maximum angle of between 10° and 90° with respect to another surface of the inboard face opposed to the one surface of the inboard face.

16. A lighting system for a vehicle, the lighting system comprising:

a power source;

a printed circuit board coupled to the power source; and a light assembly operatively connected to the printed circuit board, the light assembly including:

a light source that provides an incident light, a pair of bezels adjacent to the light source, and a light guide having:

an entrance face that receives the incident light, an exit face from which the incident light exits the light guide, an outboard face that joins the entrance face and the exit face, and an inboard face opposite to the outboard face, a side cut being positioned in the inboard face joining the inboard face to the exit face and being cut into the body of the light guide extending between the entrance face, the exit face, the outboard face and the inboard face, wherein the side cut deviates the incident light to spread the exiting light between a maximum inboard angle and a maximum outboard angle, the outboard face being substantially parallel to the inboard face.

17. The lighting system of claim 16, wherein the side cut is a curved surface pointing towards the outboard face to reflect the incident light towards the exit face.

18. The lighting system of claim 17, wherein the curved surface has a radius of curvature between 1 mm and 20 mm, a length of the light guide is between 20 mm and 100 mm, and a width of the light guide is between 5 mm and 50 mm.

19. The lighting system of claim 18, wherein the outboard maximum angle is between 10° and 100°.

20. The lighting system of claim 19, wherein the inboard maximum angle is between 10° and 90°.

* * * * *